US009202165B2

(12) United States Patent
Heinz

(10) Patent No.: US 9,202,165 B2
(45) Date of Patent: Dec. 1, 2015

(54) DEVICE FOR COUNTING OBJECTS FED AS BULK MATERIAL

(75) Inventor: Dieter Heinz, Nuremberg (DE)

(73) Assignee: COLLISCHAN GMBH & CO. KG, Nuremberg (DE)

( * ) Notice: Subject to any disclaimer, the term of this patent is extended or adjusted under 35 U.S.C. 154(b) by 0 days.

(21) Appl. No.: 13/508,869

(22) PCT Filed: Nov. 9, 2010

(86) PCT No.: PCT/EP2010/067146
§ 371 (c)(1),
(2), (4) Date: May 9, 2012

(87) PCT Pub. No.: WO2011/054974
PCT Pub. Date: May 12, 2011

(65) Prior Publication Data

US 2012/0228321 A1 Sep. 13, 2012

(30) Foreign Application Priority Data

Nov. 9, 2009 (DE) ..... 10 2009 052 292

(51) Int. Cl.
*G06M 7/00* (2006.01)
*G06M 3/02* (2006.01)
*B65B 57/20* (2006.01)

(52) U.S. Cl.
CPC . *G06M 7/00* (2013.01); *G06M 3/02* (2013.01); *B65B 57/20* (2013.01)

(58) Field of Classification Search
CPC ..... B65B 57/06; B65B 57/20; G07F 11/00; G06M 7/00; G06M 3/02
USPC ..... 221/9
See application file for complete search history.

(56) References Cited

U.S. PATENT DOCUMENTS 2,950,894 A 8/1960 Swan
3,618,819 A * 11/1971 Blackburn ..... G06M 3/02 221/2
3,708,025 A * 1/1973 Soler ..... B65B 57/20 177/1
3,977,483 A 8/1976 Greanias
3,997,063 A * 12/1976 Adams ..... B30B 11/005 221/2
4,012,622 A * 3/1977 Boys ..... G06M 11/00 235/98 R (Continued)

FOREIGN PATENT DOCUMENTS

CN 2679766 Y 2/2005
DE 25 26 897 A1 12/1976

OTHER PUBLICATIONS

English translation of First Office Action in copending Chinese application 2010800506102.

*Primary Examiner* — Gene Crawford
*Assistant Examiner* — Thomas Randazzo
(74) *Attorney, Agent, or Firm* — Lucas & Mercanti, LLP

(57) ABSTRACT

The invention relates to a device for counting objects fed as bulk material, comprising a first feeding unit for pre-counting a first fixed subset of a target quantity of objects and a second feeding unit for preferably separately feeding a second subset of the target quantity of objects, wherein the device (1, 7, 10) is designed such that the quantity of objects of the first subset is transmitted to a control apparatus (5), which controls the second feeding unit such that the second subset of objects is fed enough objects that the second subset of objects corresponds to the difference between the first subset and the target quantity of objects, and the first subset of objects is poured into the second subset of objects.

13 Claims, 2 Drawing Sheets

(56) References Cited

U.S. PATENT DOCUMENTS 4,062,413 A * 12/1977 Parker ..... G01G 13/08 177/122
4,462,517 A * 7/1984 Takata ..... A41H 37/06 198/368
4,677,283 A * 6/1987 Lewis ..... G06M 7/00 198/383
5,587,016 A * 12/1996 Altekruger ..... C30B 15/02 117/208
5,804,772 A 9/1998 Wooldridge
6,182,718 B1 * 2/2001 Seaton ..... B65B 37/04 141/128
6,257,391 B1 * 7/2001 Nishimori ..... B23P 19/001 198/358
6,742,671 B2 * 6/2004 Hebron ..... B65B 57/20 221/10
6,799,684 B2 * 10/2004 Wooldridge ..... B07C 5/38 209/551
7,128,204 B2 * 10/2006 Baranowski ..... G01G 19/393 198/752.1
7,152,756 B2 * 12/2006 Baranowski ..... B65B 1/04 221/200
7,210,598 B2 * 5/2007 Gerold et al. ..... 221/123
7,281,361 B2 * 10/2007 Wooldridge ..... B65B 57/20 53/239
7,383,862 B2 * 6/2008 Geltser ..... A61J 7/02 141/102
7,571,023 B2 * 8/2009 Mitchell ..... A61J 7/02 221/200
7,726,514 B2 * 6/2010 Janet ..... A61J 7/02 221/13
7,753,229 B2 * 7/2010 Hutchinson ..... B65B 5/103 221/13
7,861,492 B2 * 1/2011 Yuyama ..... B65B 5/103 221/2
7,930,064 B2 * 4/2011 Popovich, Jr. ..... G07F 17/0092 221/2
8,271,128 B1 * 9/2012 Schultz ..... A61J 7/02 700/236
2002/0060129 A1 * 5/2002 Cooper, III ..... B65G 47/1492 198/443
2006/0025884 A1 * 2/2006 Henkel ..... B65B 5/103 700/216
2006/0201961 A1 * 9/2006 Abdulhay ..... G07F 11/10 221/9
2007/0056981 A1 * 3/2007 Geltser ..... B65B 57/20 221/9

* cited by examiner

DEVICE FOR COUNTING OBJECTS FED AS BULK MATERIAL

This application is a 371 of PCT/EP2010/067146 filed Nov. 9, 2010, which in turn claims the priority of DE 10 2009 052 292.1 filed Nov. 9, 2009, the priority of both applications is hereby claimed and both applications are incorporated by reference herein.

The invention relates to an apparatus for counting objects fed as bulk material, having a first feeding device for the preliminary counting of a first defined sub-quantity of a desired number of objects, and having a second feeding device for the preferably separate feeding of a second sub-quantity of the desired number of objects.

Apparatuses which are intended for counting objects fed as bulk material and which can count products such as tablets, pellets, certain foodstuffs or electronic components, so that a precisely defined number of products can then be processed further or packaged, are already known. In the case of such counting apparatuses, the objects pass from a filling hopper into conveying channels which are arranged parallel to one another and are closed gradually during the metering operation.

Other apparatuses, in which metering is controlled by weight, are also known. Since the mass of the individual objects is usually subject to fluctuation, the overall weight sensed can be used to draw only approximate conclusions in respect of the precise number of objects. In certain cases, however, it is necessary to determine the precise number of objects, which is not possible with conventional apparatuses, on account of the weight-controlled metering.

It is therefore an object of the invention to specify an apparatus which is intended for counting objects fed as bulk material and which can count a defined desired number of objects quickly and precisely.

This object is achieved by an apparatus of the type mentioned in the introduction, which is designed such that the number of objects in the first sub-quantity is communicated to a control device, which controls the second feeding device such that the second sub-quantity of objects is fed as many objects as are necessary in order for the second sub-quantity of objects to correspond to the difference between the first sub-quantity and the desired number of objects, and the first sub-quantity of objects is poured into the second sub-quantity of objects.

The invention is based on the concept of the metering of objects which are present in the form of bulk material taking place not in dependence on the weight sensed, but instead with reference to the individual objects counted, so that it is ensured that the defined desired number of objects is observed precisely. For this purpose, the preliminary counting of a first defined sub-quantity of the desired number of objects takes place via a first feeding device, wherein the precise number of objects is sensed. The second feeding device is then controlled such that it feeds as many objects as are necessary in order for the second sub-quantity of objects to correspond to the difference between the first sub-quantity and the desired number of objects. The operations of conveying and counting the second sub-quantity of objects take place more slowly than in the case of the first sub-quantity since they have to be carried out with a high degree of precision, in order that the defined desired quantity of objects is not exceeded.

According to the invention, it may be provided that the apparatus has a container into which the first sub-quantity of the desired number of objects is poured following the preliminary counting. This container serves as an interim store, in which the objects counted are collected until the second sub-quantity of objects has been counted.

A particularly advantageous development of the apparatus according to the invention provides that, during the feeding of the second sub-quantity of the desired number of objects, the control device controls the preliminary counting of the first sub-quantity for the next counting operation. This makes it possible for the second sub-quantity to be fed and counted while, at the same time, the first sub-quantity of objects for the next counting operation is being fed and counted. It is thus possible for the operations of counting the first sub-quantity and the second sub-quantity of objects to overlap in time, or to be carried out in parallel, so that the desired number of objects can be counted more quickly overall.

In the case of the apparatus according to the invention, the first feeding device and/or the second feeding device may be designed as a vibratory conveying path, in particular as a vibratory channel. The bulk material can be conveyed in a controlled manner via this vibratory channel, wherein the quantity and the speed of the bulk material conveyed can be adjusted by means of the control device, via the intensity of vibration. As an alternative, it is possible for the first feeding device and/or the second feeding device to be driven by means of a servomotor.

It is particularly advantageous if, in the case of the apparatus according to the invention, the vibratory conveying path is controlled or regulated by the control device, with reference to the objects counted, such that the speed of the objects fed is reduced as the defined sub-quantity of objects is approached. Accordingly, the objects at the start of a counting operation are fed comparatively quickly via the vibratory conveying path; prior to the desired number for the first sub-quantity and/or second sub-quantity of objects being reached, the conveying speed is reduced, so that this desired number can be observed precisely.

In the case of the apparatus according to the invention, it may be provided that it has a counting module for counting the objects, or a first counting module for counting the first sub-quantity and a second counting module for counting the second sub-quantity of objects, wherein the counting modules are designed preferably for contactless counting of the objects. The counting modules may be positioned downstream of the vibratory channel, so that the objects leave the vibratory channel, and are counted, in free fall. The counting modules are able to sense the number of objects in an extremely precise manner via corresponding sensors, even should one object be concealed wholly or partially by another object.

The counting module used in the case of the apparatus according to the invention can make use of different measuring methods, for example it may be designed for optical and/or electromagnetic and/or capacitive and/or acoustic sensing of the objects.

According to a development of the apparatus according to the invention, it may be provided that the first feeding device has a shutter which is closed when the desired number for the first sub-quantity of objects is reached. In this way, the stream of objects conveyed is interrupted when the first desired number of objects is reached, so that no further objects are fed via the first feeding device. The rest of the objects required are then fed exclusively via the second feeding device.

It is also possible, within the context of the invention, for the first feeding device and the second feeding device to be regulated separately from one another. This means that, when the first sub-quantity of objects is complete, conveying by the first feeding device can be terminated, for example by virtue of the shutter being dosed, whereupon the first feeding device is stopped. The operations of feeding and counting the second sub-quantity of objects then takes place, by merely the second feeding device being driven. This prevents the objects from accumulating upstream of the shutter in the first feeding device, which otherwise would make it more difficult for the individual objects to be counted precisely.

The apparatus according to the invention is preferably designed such that the first feeding device can feed 90 to 95% of the desired number of objects; the difference from the desired number of objects is fed by the second feeding device.

If, in exceptional cases, too many objects have been conveyed, that is to say if the second sub-quantity of objects conveyed and counted is greater than the difference between the first sub-quantity of the desired number of objects and the desired number, it is possible for the second sub-quantity of objects to be rejected, by being poured, for example, into a special container. This is followed by a second sub-quantity of objects being fed and counted once again, so that the desired number of objects is reached precisely. In the case of the apparatus according to the invention, it is thus necessary to reject, if need be, the comparatively small second sub-quantity of objects, but not the larger first sub-quantity of objects. This is particularly advantageous since, in the case of certain applications, separated-out objects must not be re-introduced into the metering operation.

Further advantages and details of the invention will be described by way of exemplary embodiments and with reference to the drawings, in which, schematically:

Figure 1:
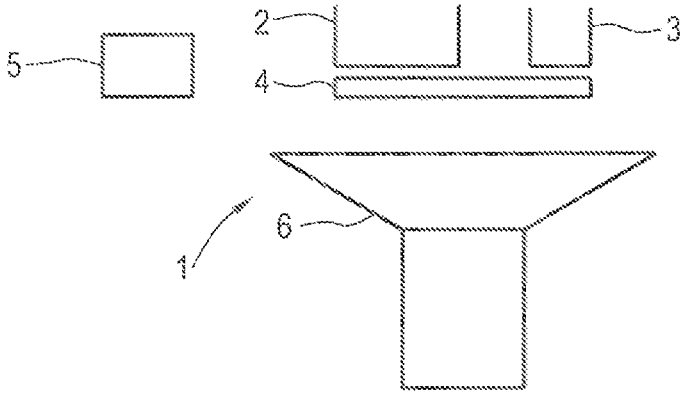
FIG. 1 shows a first exemplary embodiment of an apparatus according to the invention.

The apparatus 1 shown in FIG. 1 comprises a first feeding device for the preliminary counting of a first defined sub-quantity of a desired number of objects fed as bulk material. The objects may be, for example, tablets, capsules, electronic components or pellets. The first feeding device comprises a comparatively wide vibratory channel 2, via which the objects are fed. The vibrations generated cause all the objects to move in the form of a stream along the vibratory channel 2. In addition, the apparatus 1 comprises a second feeding device, for feeding a second sub-quantity of the desired number of objects. The second feeding device comprises a vibratory channel 3, which is designed to be smaller and/or narrower than the first vibratory channel 2. The first feeding device and the second feeding device can be driven separately from one another in each case via drive means, so that, in a certain operating state, one feeding device conveys objects while the other feeding device is at a standstill. The two feeding devices are designed as vibratory conveying paths in the case of which the control or regulation of the vibratory movement makes it possible to adjust the quantity and the speed of the bulk material conveyed.

The apparatus 1 can be used to count a certain desired number, for example 100; of objects, it being possible for this number to be defined in any manner required. This desired number is made up of a first defined sub-quantity, which is fed via the first feeding device, and of a second sub-quantity, which is fed via the second feeding device. In the exemplary embodiment illustrated, the first sub-quantity comprises 95 objects and the second sub-quantity comprises 5 objects. Once the open end of the vibratory channel 2 has been reached, the objects fall downward from the vibratory channel 2. While the objects are in free fall, they are counted by a counting module 4, which is illustrated merely schematically in the drawing. The counting module 4 has sensors which can measure the number of passing objects with a high degree of accuracy, even if the objects are concealing one another wholly or partially. Accordingly, in the exemplary embodiment illustrated, the first feeding device feeds the objects as bulk material until 95 objects have been counted. During the operation of conveying the objects, the vibratory channel 2 is controlled by a schematically illustrated control device such that the speed of the objects fed is reduced as the defined desired-number sub-quantity comprising 95 objects is approached. Any further feeding of objects is prevented by a shutter (not shown in FIG. 1) which doses the vibratory channel 2. This prevents too many objects from being fed accidentally. However, it is possible for the first sub-quantity of objects not to comprise 95 objects precisely; instead, it would also be possible for the counting module 4 to count 93 or 97 objects. The number of objects counted in the first sub-quantity is then communicated to a control device 5, which then controls the second feeding device with the vibratory channel 3 such that the second sub-quantity of objects is fed as many objects as are necessary in order for the second sub-quantity of objects to correspond to the difference between the first sub-quantity and the desired number of objects. If the first sub-quantity comprises 95 objects, five further objects are thus fed via the vibratory channel 3; if the first sub-quantity comprises 97 objects, just three further objects are fed via the vibratory channel 3. The objects free fall from the vibratory channel 3 to the counting module 4, which counts the objects as they pass by. If the sum of the objects in the first sub-quantity and the objects in the second sub-quantity corresponds to the desired number of objects, the objects are supplied, via an outlet hopper 6, for filling purposes, packaging purposes or for further processing steps.

Figure 2:
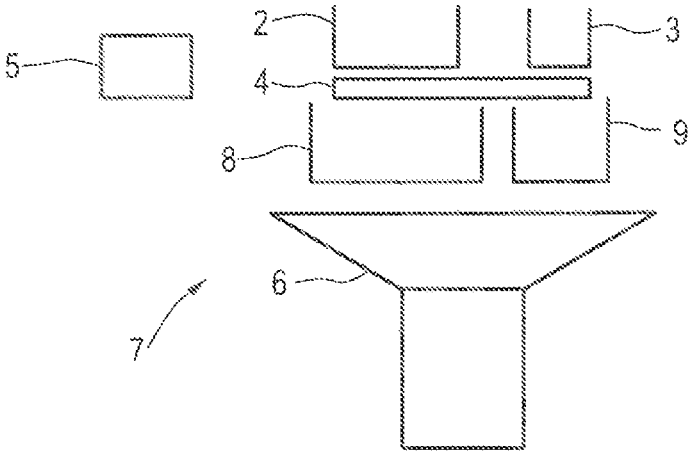
FIG. 2 shows a second exemplary embodiment of an apparatus according to the invention.

FIG. 2 shows a second exemplary embodiment, having an apparatus 7, wherein corresponding constituent parts have been designated by the same designations as in the first exemplary embodiment, in correspondence with the first exemplary embodiment, the apparatus 7 comprises feeding devices which are designed as vibratory channels 2, 3 and have a counting module 4 positioned downstream of them. The vibratory channels 2, 3 are regulated via the control device 5.

A container 8 is located beneath the vibratory channel 2, so that the objects are collected in the container 8 once they pass by the counting module 4. A container 9 is located beneath the vibratory channel 3, and the objects from the vibratory channel 3 pass into this container once they pass by the counting module 4.

While the second sub-quantity of objects is being counted via the vibratory channel 3 and collected in the container 9, the control device 5, which is connected to the individual components of the apparatus 7 via lines (not illustrated specifically), initiates, and controls, the preliminary counting of the first sub-quantity of objects for the next metering and counting operation, so that the two counting operations overlap in time. Since, at least in certain operating states, objects are fed simultaneously via the vibratory channels 2, 3, the apparatus 7 can be used to count a certain desired number of objects with a high degree of accuracy more quickly than an apparatus which has just one single conveying path.

Figure 3:
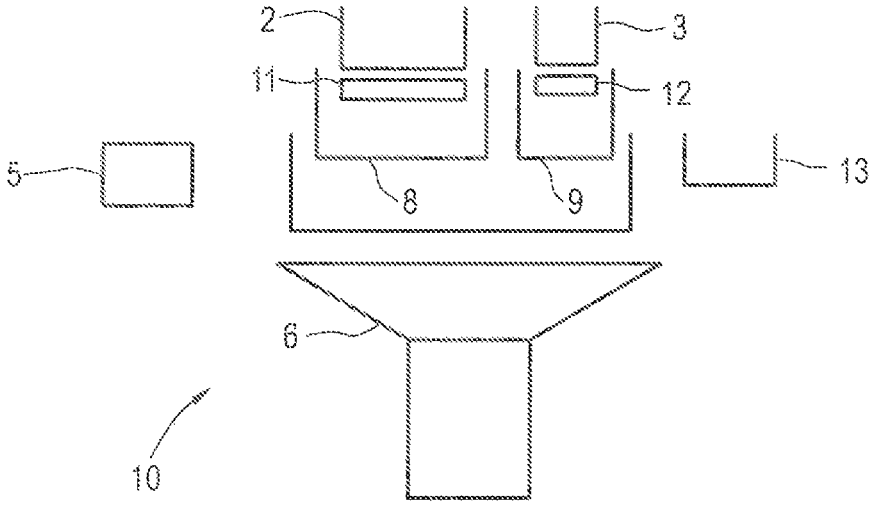
FIG. 3 shows a third exemplary embodiment of an apparatus according to the invention.

FIG. 3 shows a third exemplary embodiment of the invention, wherein, once again, corresponding constituent parts have been designated by the same designations as in the previous exemplary embodiments. The apparatus 10 comprises feeding devices designed as vibratory channels 2, 3, wherein the objects fall from the vibratory channel 2 into the container 8 and from the vibratory channel 3 into the container 9. In contrast to the previous exemplary embodiments, each feeding device is assigned a separate counting module. The objects fed by the vibratory channel 2 are sensed by the counting module 11, and the objects fed via the vibratory channel 3 are sensed via the counting module 12. Using two separate counting modules makes it possible to improve accuracy further, since the objects counted can clearly be assigned to the respective feeding device.

In exceptional cases, it may be so that the number of objects in the container 9 does not correspond with the difference between the number of objects in the container 8 and the desired number of objects, for example if 95 objects are located in the container 8 and six objects are located in the container 9. When this error is observed by the control device 5, the contents of the container 9 can be poured into a container 13, as a result of which the objects of the container 9 are separated out. However, the number of objects in the bulk material which have to be separated out when the desired number of objects is exceeded is advantageously small in comparison with the desired number of objects. Once the objects of container 9 have been rejected, and poured into the container 13, the control device 5 initiates a new counting operation, by the emptied container 9 being re-filled with objects via the vibratory channel 3 until the second sub-quantity of objects corresponds to the difference. The container 13 shown in the drawing, however, is optional; as far as extremely precise counting using the counting modules 8, 9 is concerned, embodiments without a container 13 are also possible.

The invention claimed is:

1. An apparatus for counting objects fed as bulk material, comprising:

a first feeding device with a first conveying path for bulk feeding of a first defined sub-quantity of a desired number of objects as bulk material, and a second feeding device with a second conveying path for separate bulk feeding of a second sub-quantity of the desired number of objects as bulk material, a first counting module for counting the objects bulk fed by the first feeding device and a second counting module for counting the objects bulk fed by the second feeding device, wherein the objects leave the first feeding device and the second feeding device in free fall, the first counting module and the second counting module are respectively arranged downstream of the first feeding device and the second feeding device, and are designed for contactless counting of the objects while the objects are in free fall, wherein the counted number of objects in the first sub-quantity is communicated to a control device, which controls the second feeding device such that the second sub-quantity of objects is fed as many objects as are necessary in order for the second sub-quantity of objects to correspond to the difference between the first sub-quantity and the desired number of objects, and the first sub-quantity of objects is poured into the second sub-quantity of objects to obtain the desired number of objects, and wherein, during the feeding of the second sub-quantity of the desired number of objects for a current counting operation, the control device controls the preliminary counting of the first sub-quantity for a next counting operation.

2. The apparatus of claim 1, further comprising a container into which the first sub-quantity of the desired number of objects is poured following the preliminary counting.

3. The apparatus of claim 1, wherein the counting modules for sensing the objects are one or more sensors selected from optical sensors, electromagnetic sensors, capacitive sensors, or acoustic sensors.

4. The apparatus of claim 1, wherein the first feeding device has a shutter which is closed by the control device when the desired number for the first sub-quantity of objects is reached.

5. The apparatus of claim 1, wherein the first feeding device and the second feeding device can be regulated separately from one another.

6. The apparatus of claim 1, wherein the first feeding device can feed 90 to 95% of the desired number of objects.

7. The apparatus of claim 1, wherein the first conveying path and the second conveying path are vibratory conveying paths.

8. The apparatus of claim 1, wherein the first feeding device or the second feeding device is driven by a servomotor.

9. The apparatus of claim 1, wherein the first feeding device and the second feeding device are driven by a servomotor.

10. The apparatus of claim 1, wherein the first counting module and the second counting module are optical sensors.

11. The apparatus of claim 1, wherein the first counting module and the second counting module are configured to sense objects that that conceal each other partially or wholly.

12. The apparatus of claim 1, wherein the first feeding device or the second feeding device is a vibratory conveying path.

13. The apparatus of claim 12, wherein the vibratory conveying path is controlled or regulated by the control device, with reference to the objects counted, such that the speed of the objects fed is reduced as the defined sub-quantity of objects is approached.

* * * * *